United States Patent [19]

Lee

[11] Patent Number: 4,804,345

[45] Date of Patent: Feb. 14, 1989

[54] EQUIPMENT FOR TOWLESS SKIING ON WATER SURFACE

[76] Inventor: Jong S. Lee, #1-38, Choong-ku, Apt. D-408, Daejeon, Choong-nam, Rep. of Korea

[21] Appl. No.: 25,261

[22] Filed: Mar. 12, 1987

[30] Foreign Application Priority Data

| | | | |
|---|---|---|---|
| Mar. 17, 1986 | [KR] | Rep. of Korea | 3184[U] |
| Sep. 15, 1986 | [KR] | Rep. of Korea | 14296[U] |
| Nov. 29, 1986 | [KR] | Rep. of Korea | 16897 |
| Nov. 29, 1986 | [KR] | Rep. of Korea | 16898 |

[51] Int. Cl.[4] ..... A63C 15/03

[52] U.S. Cl. ..... 440/21; 416/70 R; 440/101; 441/76

[58] Field of Search ..... 441/68, 76, 77; 114/56, 114/63, 271, 291; 440/48, 13, 17, 19, 21, 101; 416/69, 70 R

[56] References Cited

U.S. PATENT DOCUMENTS

| | | | |
|---|---|---|---|
| 1,533,023 | 4/1925 | Meredith | 441/77 |
| 2,482,074 | 9/1949 | Stephens | 441/77 |
| 2,589,698 | 3/1952 | Jackson | 440/101 X |
| 3,144,849 | 8/1964 | Maser | 441/76 |
| 3,426,721 | 2/1969 | Justinien | 440/48 |
| 4,301,562 | 11/1981 | Durr | 441/76 |
| 4,541,809 | 9/1985 | Schaumann | 441/76 |
| 4,599,072 | 7/1986 | Pollini et al. | 441/76 X |

FOREIGN PATENT DOCUMENTS

| | | | |
|---|---|---|---|
| 3127408 | 1/1983 | Fed. Rep. of Germany | 441/76 |
| 0315995 | 12/1834 | Italy | 441/76 |
| 901112 | 7/1962 | United Kingdom | 441/76 |

*Primary Examiner*—Sherman D. Basinger
*Attorney, Agent, or Firm*—Donald A. Kettlestrings

[57] ABSTRACT

Equipment for towless skiing on water surface includes a pair of propulsion sticks having buoyant members at one end and handles at the other end. The buoyant members provide increased thrust against the hydrodynamic resistance of the water, and the shape of the buoyant members permits removal of the buoyant members from the water with little resistance. The equipment also includes a pair of skis comprised of foam material and provided with stabilizing shoulders on both sides of each ski for minimizing the effect of nose diving and rolling of the skis in the surf. The cross-sectional areas of the buoyant members and of the skis are such that maximum propulsion forces are provided. The skis are designed to endow the surf skier with a greater degree of freedom during surf skiing and to enable the skier to ski for longer distances on the water.

20 Claims, 5 Drawing Sheets

Fig.15.
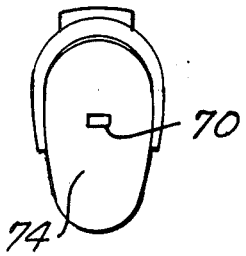
Fig.16.
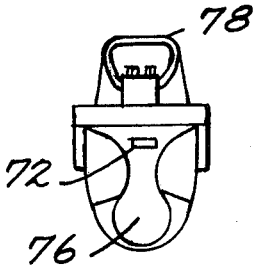
Fig.19.
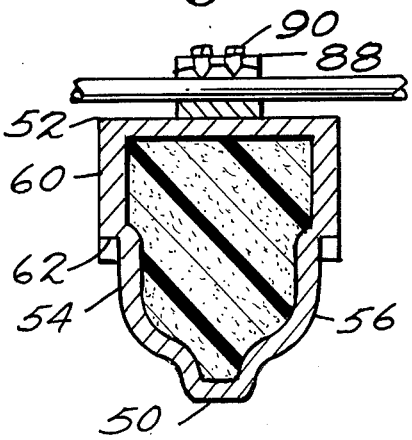
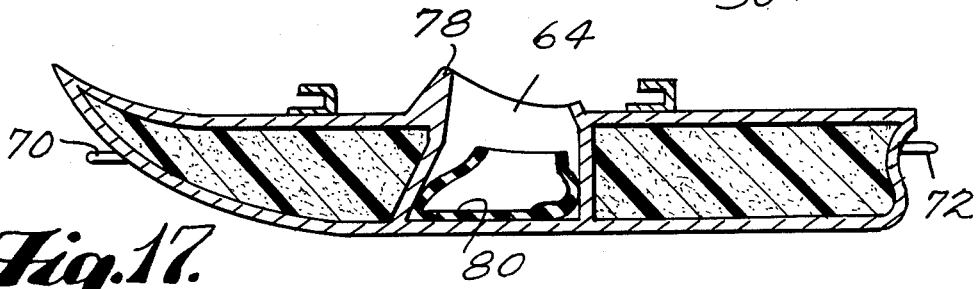
Fig.17.
Fig.18.
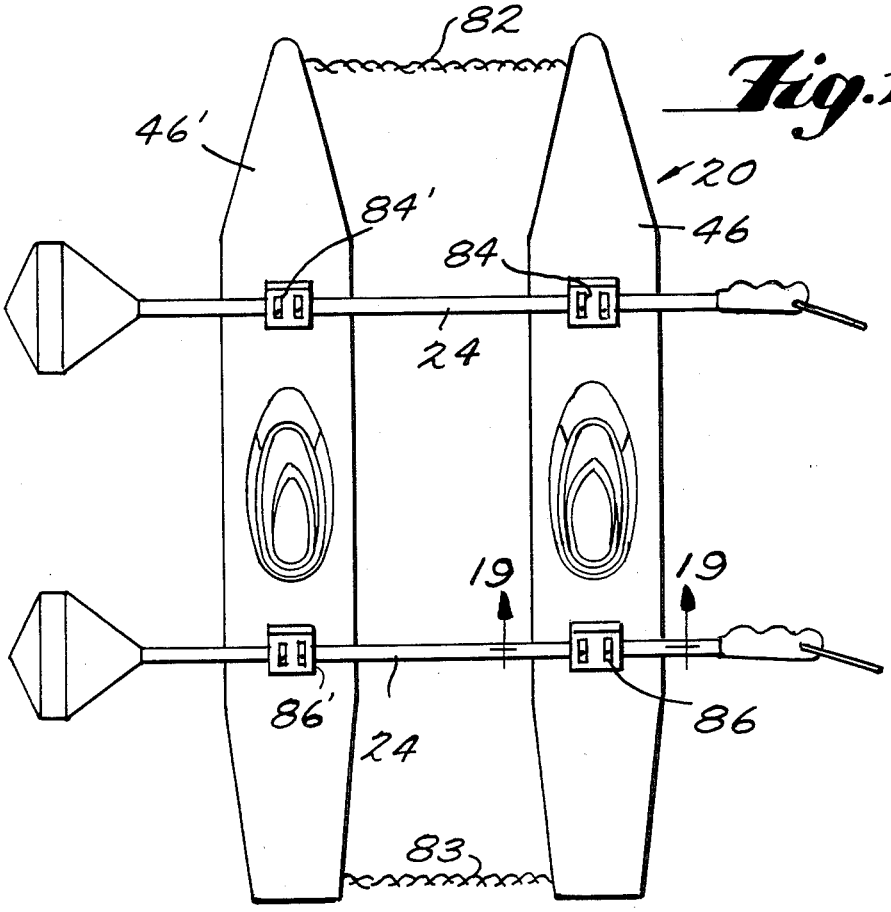

EQUIPMENT FOR TOWLESS SKIING ON WATER SURFACE

BACKGROUND OF THE INVENTION

This invention relates to equipment for surf skiing on the water surface and more particularly to a pair of propulsion sticks to be used with a pair of surf skis.

It is well known that movement on water by human power may be accomplished by oaring, paddling, poling and rowing. Also known is walking or gliding on the water surface with or without water sticks or poles. In recent years, the most successful of such systems for movement on water surface and for towless aquatic skiing has been use of a pair of shoes integral with floating skis with the user's feet on the skis' surface or inside of the skis and a pair of sticks with or without an impact racket. Such an arrangement is made only for walking or strolling on the water surface with or without the support of sticks kicking backward, i.e. by repulsive force due to its impact on the water surface.

True skiing on the water surface has only been possible by use of water skis towed by a motor boat. However, surf skiing in a forward direction by human power can be accomplished on the water surface by displacing backward a certain amount of water by use of a buoyant member having a predetermined cross-sectional area. The buoyant member is repetitively popped up out of the water after having displaced or pushed a predetermined amount of water. This means that the buoyant member should not only be designed to have an appropriate cross-sectional area but also must be water tight to keep proper buoyancy. The buoyant member should also be designed to have minimum hydrodynamic drag during the phase of withdrawal from the water after each push. The buoyant member should be shaped substantially like a diamond and its cross-sectional area should be greater than the maximum cross-sectional area of each ski's body. In accordance with this invention, each ski body is designed to satisfy the following four characteristics; the first is to maximize the speed of each surface ski, the second is to allow a proper maneuverability, the third is to keep a stability and the last is to increase an ability to reride the surf skis when the user falls off. All of these characteristics are satisfied by this invention in order to provide a greater degree of freedom to the surf skier during surf skiing and to make longer trips on the water possible while lessening skier fatigue.

It is, therefore, an object of the present invention to provide equipment for enabling human propulsion in water sports.

Another object is to provide equipment for towless skiing on the water surface.

A further object of the invention is the provision of propulsion sticks designed to provide significant thrust in the water and which easily rise out of the water after each pushing action by the user.

Still another object is to provide surf skis which are optimized for speed, maneuverability, stability and the ability to ride in deep water.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides a pair of propulsion sticks, each stick comprising: a rod; a hand grip located at a first end of the rod; and a water-buoyant member located at a second end of the rod. In accordance with the invention, the equipment for towless skiing includes a pair of skis, each ski comprising an elongated ski-shaped body defining a bottom surface and an upper surface; first and second opposed side surfaces extending between the upper and bottom surfaces; the bottom surface curving upwardly in a forward direction at a forward end of the body to meet the upper surface; the first and second side surfaces each defining a shoulder extending downwardly from the upper surface and along the length of the body; each of the shoulders further defining a lower surface substantially perpendicular to the side surface which extends along the length of the body; and the body defining a cavity for receiving a user's foot and the lower part of the user's leg.

The front section of the body of each ski is constructed to experience low drag loss, and the rear section of each ski body is formed of a shape similar to a human heel. Shin guards are provided at the top and front edge of cavities within each ski body with enough space for permitting easy insertion and withdrawal of the lower part of the user's leg. The stability of each ski is also enhanced by extending stabilizing shoulders or side fins from the upper surface of each ski with decreasing slope in the leading part to prevent the effect of nose diving and with increasing slope in the trailing part to aid the prevention of side rotation. The increased facility for the user reriding the skis is provided by a system of connected safety ropes which are attached at rings located at each nose and heel portion of each ski, and the rods of each propulsion stick can be positioned within holding sockets or clamps attached to the upper surface of each ski to further stabilize the positions of the skis with respect to each other.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

FIG. 15 is a front end elevation view of a surf ski in accordance with this invention.

FIG. 16 is a rear end elevation view of a surf ski in accordance with this invention.

FIG. 17 is a cross-sectional view of a surf ski in accordance with this invention taken along the line 17—17 in FIG. 12 and looking in the direction of the arrows.

FIG. 18 is a top plan view of a catamaran structure in accordance with this invention.

FIG. 19 is a cross-sectional view of a surf ski in accordance with this invention taken along the line 19—19 in FIG. 18 and looking in the direction of the arrows.

DETAILED DESCRIPTION OF THE PREFERRED EMBODIMENTS

Figure 1:
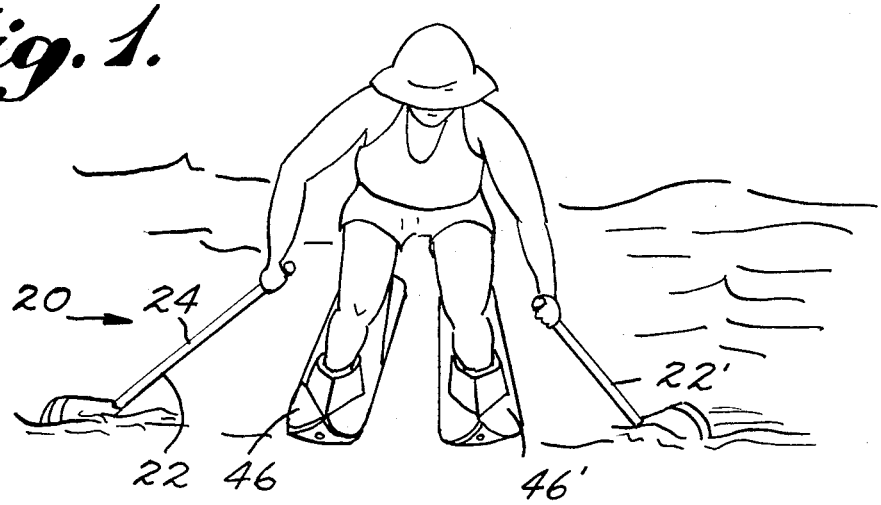
FIG. 1 is a pictorial front view of a surf skier's motion during surf skiing with the equipment of this invention.
Figure 2:
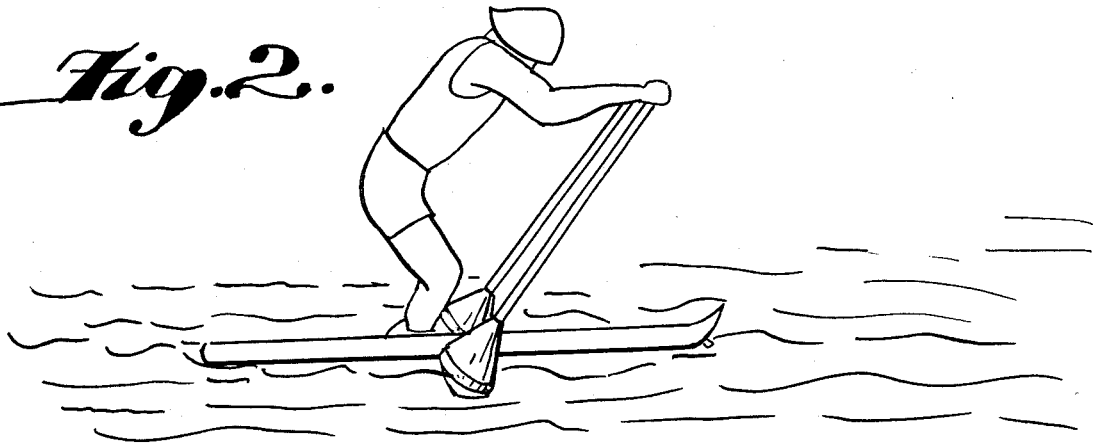
FIG. 2 is a pictorial side view of a surf skier's draw motion during surf skiing with a pair of propulsion sticks in accordance with this invention.
Figure 3:
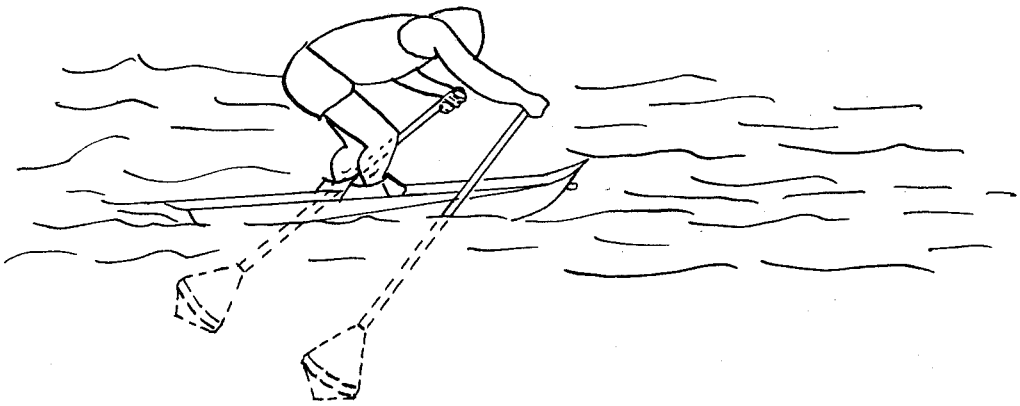
FIG. 3 is a pictorial side view of a surf skier's pushing motion during surf skiing with a pair of propulsion sticks in accordance with this invention.
Figure 4:
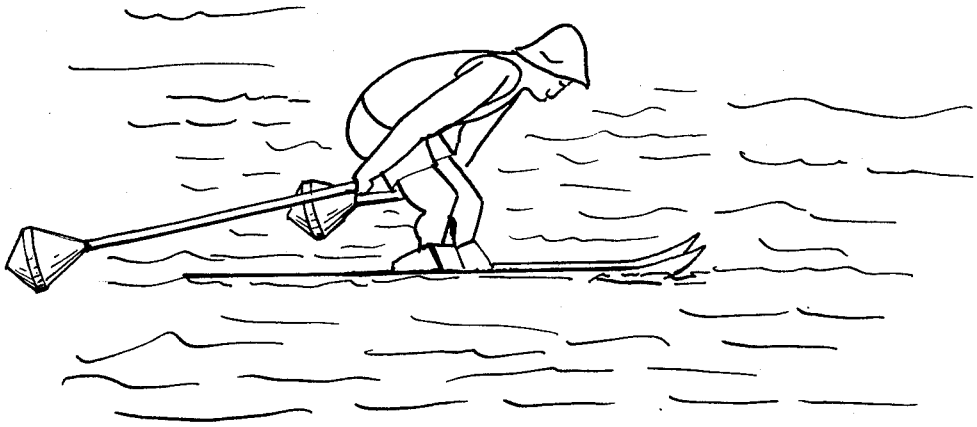
FIG. 4 is a pictorial side view of a surf skier's release motion during surf skiing with a pair of propulsion sticks in accordance with this invention.
Figure 5:
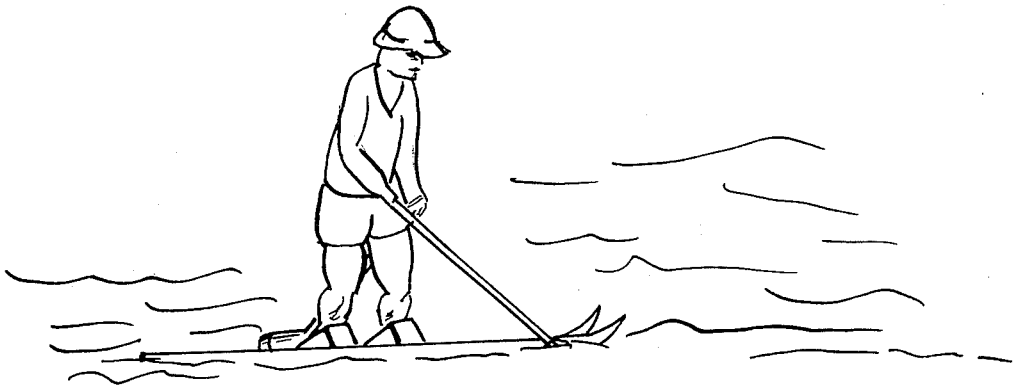
FIG. 5 is a pictorial side view of a surf skier's turning motion by use of a coupling effect with a pair of propulstion sticks in accordance with this invention.

With reference now to the drawings, wherein like reference characters designate like or corresponding parts throughout the several views, there is shown equipment 20 for towless skiing on water surface. Equipment 20 includes a pair of propulsion sticks 22, 22', and each stick is comprised of a rod 24, a hand grip 26 located at a first end 28 of rod 24, and a water-buoyant member 30 is located at a second end 32 of rod 24.

Buoyant member 30 defines a conical part 34, a truncated conical part 36 attached to rod 24 and a cylindrical part 38 between conical part 34 and truncated conical part 36.

Figure 8:
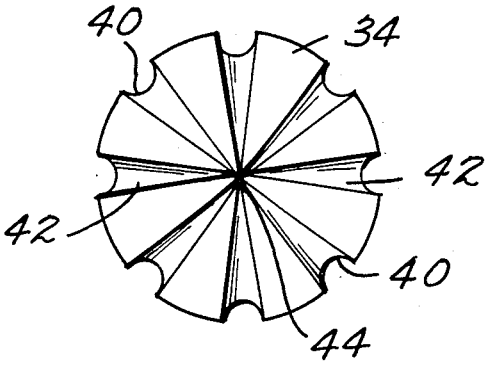
FIG. 8 is a bottom view of a propulsion stick in accordance with this invention.
Figure 9:
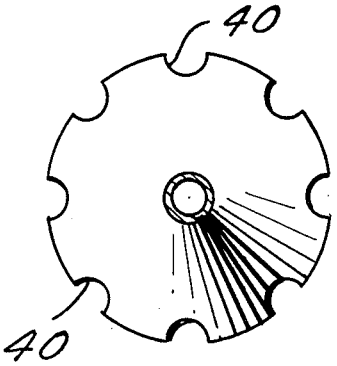
FIG. 9 is a top plan view of a propulsion stick in accordance with this invention.
Figure 6:
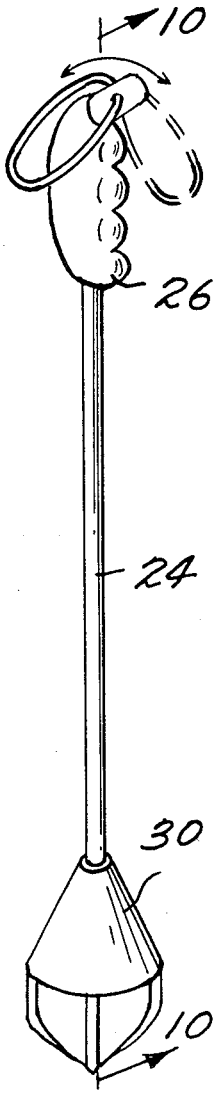
FIG. 6 is a perspective view of a propulsion stick in accordance with this invention.
Figure 10:
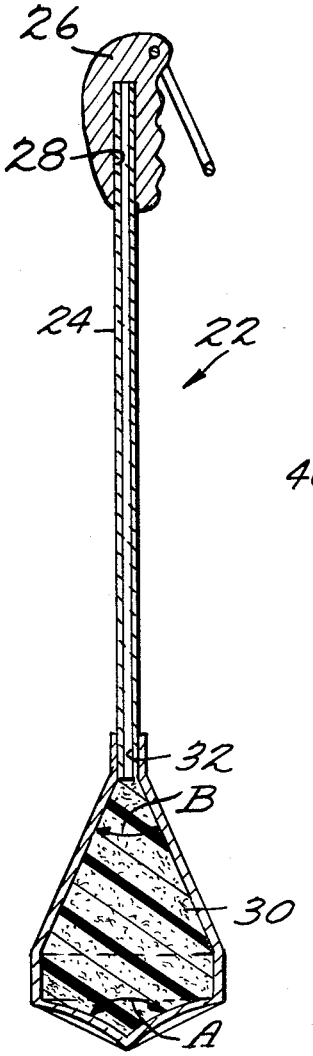
FIG. 10 is a longitudinal sectional view of a propulsion stick of this invention taken along the line 10—10 in FIG. 6 and looking in the direction of the arrows.
Figure 7:
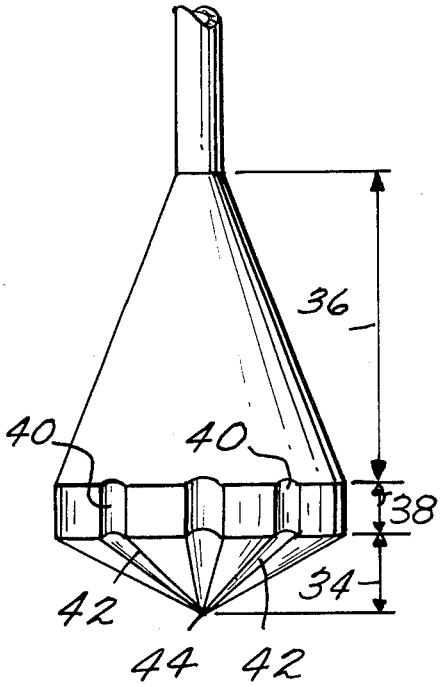
FIG. 7 is a fragmentary side elevation view of a propulsion stick in accordance with this invention and illustrating the water-buoyant member portion of the stick.
Figure 11:
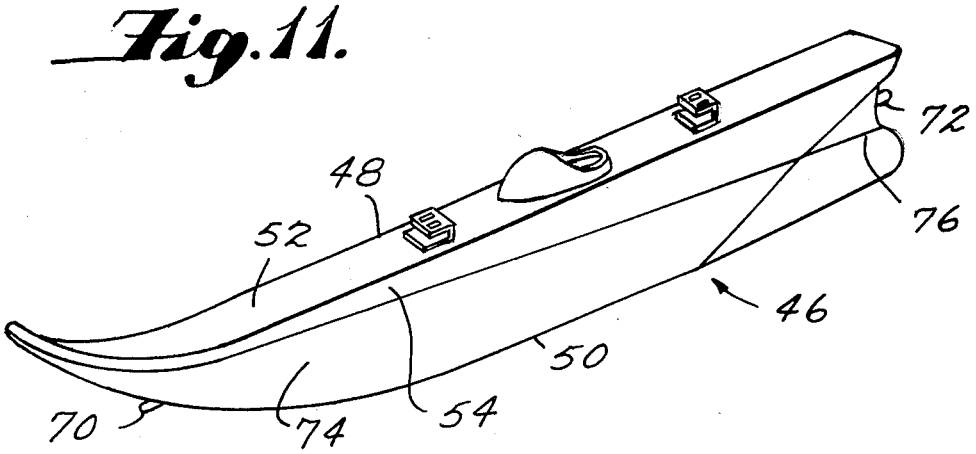
FIG. 11 is a perspective view of a surf ski in accordance with this invention.

As best illustrated in FIGS. 7-9, cylindrical part 38 defines a first plurality of grooves 40 substantially equally spaced apart around the exterior surface of cylindrical part 38, and conical part 34 defines a second plurality of grooves 42 radiating from the apex 44 of conical part 34 and substantially equally spaced apart around the exterior surface of the conical part. Each of second plurality of grooves 42 is aligned with and in communication with one of the first plurality of grooves 40 to form a single, continuous depression. The interior apex angle A, best illustrated in FIG. 10, on conical part 34 is substantially greater than the imaginary interior apex angle B of truncated conical part 36.

Preferably, the height of cylindrical part 38 is substantially equal to the height of conical part 34, and the height of truncated conical part 36 is preferably substantially greater than the height of cylindrical part 38. In accordance with the invention, truncated conical part 36 is at least substantially five times greater in height than the height of cylindrical part 38.

Buoyant member 30 is comprised of a foam material.

The motions used during surf skiing with equipment 20 are illustrated in FIGS. 1-5. Each part of buoyant member 30 plays a part in moving the skier in a desired manner. Conical part 34 acts as a penetrater into the water to keep the skier moving in a predetermined direction. Cylindrical part 38 acts as a hydrodynamic resister against water friction during the pushing motion in the water. Truncated conical part 36 acts to facilitate easy removal of buoyant member 30 from the water. Buoyant member 30 is constructed in a shape to provide greater thrust and to facilitate rise in the water by using the princple of Archimedean buoyancy. The conceptional usage of this principle is derived from experiences in the water and air; the pop-up of empty long neck bottles out of water after release from push-down up to its neckline into the water and the rise of balloons with rotation in the air after release from an up-side-down position. Grooves 40, 42 are formed on the lower part of buoyant member 30 to prevent its side rotation during contact with the water surface.

Equipment 20 also includes a pair of skis 46, 46', which are best illustrated in FIGS. 11-19. Each ski includes an elongated ski-shaped body 48 which defines a bottom surface 50 and an upper surface 52. First and second opposed side surfaces 54, 56 extend between upper surface 52 and bottom surface 50. Bottom surface 50 curves upwardly in a forward direction at a forward end 58 of body 48 to meet upper surface 52.

Each of side surfaces 54, 56 defines a shoulder 60 which extends downwardly from upper surface 52 and along the length of body 48. Each of shoulders 60 further defines a lower surface 62 substantially perpendicular to the side surfaces, and surface 62 extends along the length of body 48. Body 48 also defines a cavity 64 for receiving a user's foot and the lower part of the user's leg.

Figure 14:
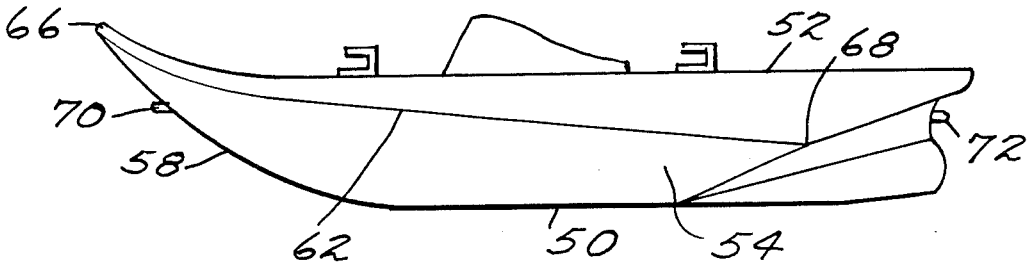
FIG. 14 is a side elevation view of a surf ski in accordance with this invention.

Lower shoulder surface 62 defines a slope with respect to bottom surface 50, as best illustrated in FIG. 14, which decreases in a predetermined manner as lower surface 62 extends from front 66 to body 48 to predetermined location 68 along the length of body 48. Lower surface 62 further defines a slope with respect to bottom surface 50 which increases in a predetermined manner as lower surface 62 extends rearwardly from predetermined location 68.

In accordance with the invention, each of skis 46, 46' includes a first rope-fastening element 70 attached to a forward portion of bottom surface 50 and a second rope-fastening element 72 is attached to a rearward portion of bottom surface 50. Rope-fastening element 70 is located above the immersion line of each ski and rope-fastening element 72 is located below the immersion line of the ski.

Skis 46, 46' are comprised of foam material.

In order to provide maximum propulsion, the maximum cross-sectional area of each buoyant member 30 should be greater than the maximum cross-sectional area of each ski.

Figure 12:
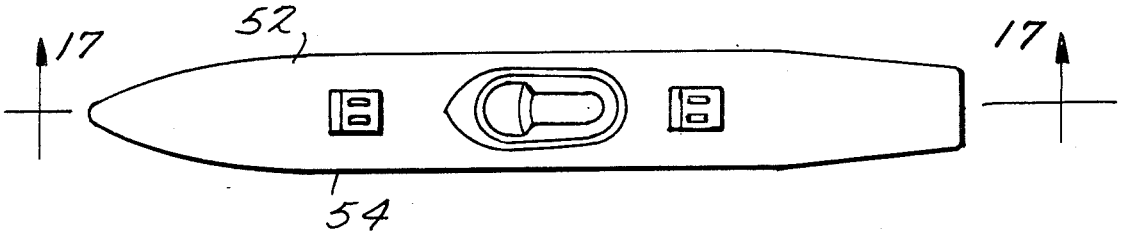
FIG. 12 is a top plan view of a surf skin in accordance with this invention.
Figure 13:
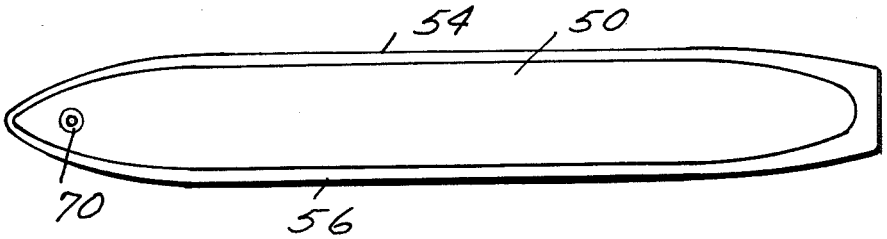
FIG. 13 is a bottom view of a surf ski in accordance with this invention.

Each ski 46, 46' is constructed with a snow ski shape, as seen in FIG. 12. Each ski is also provided with a bottom which facilitates walking into the water from the shore and surf skiing on shallow, rough or deep water. The decreasing slope of lower shoulder surface 62 from the forward end toward the rear of each ski prevents the effect of nose diving, and the increasing slope of lower shoulder surface 62 from predetermined location 68 to the rear portion of each ski prevents side rolling of each ski and facilitates easy turning.

The shape of each ski body is divided into two parts. The leading part 74 is formed in the shape of a racing boat to minimize the drag loss, and the trailing part 76 is formed in the shape of a human heel to prevent side rolling and to facilitate during turning.

Each ski 46, 46' also turning a shin guard 78 which is built at the top and front edge of cavity 64 to accommodate the lower part of the user's leg and whereby the user's foot can be releasably positioned on the the bottom 80 of cavity 64.

Skis 46, 46' are also connected by safety ropes 82, 83 (FIG. 18) which are fastened, respectively, at fastening elements 70, 72. The position of fastener element 70 above the immersion line of each ski and the position of fastener element 72 below the immersion line of each ski causes a small amount of moment due to hydrodynamic resistance to improve the stability of the skis. Ropes 82, 83 also prevent side drifting of the skis, and the ropes greatly improve the maneuverability of the skis during surf skiing as the skier's leg is forced against guard 78. The moment due to this force is created by the moment arm from the user's foot positioned on bottom 80 of cavity 64 to shin guard 78. By use of this moment, the skier can easily control the position of the surf skis with respect to the water surface and the direction of movement of the skis. Moving forward, backward and turning is easily controlled. The spacing between the pair of skis during surf skiing becomes narrower for the limited length of safety ropes 82, 83 so as to decrease the drag loss of the skis as the speed of the skis over the water increases.

A catamaran structure is illustrated in FIG. 18. Skis 46, 46' are connected by safety ropes 82, 83, and clamps 84, 84', 86 and 86' receive rods 24 of each propulsion stick 22. When propulsion sticks 22, 22' are positioned within the clamps, a rigid and stable catamaran structure is provided. Each clamp preferably comprises a ballbearing 88 and a spring 90 (see FIG. 19). Each clamp is a push-in type in order to make it easier to construct. The primary purpose of the clamps and the catamaran structure provided by the propulsion sticks and the skis is to reride the skis when the skier falls off. The first step for reriding the skis is for the skier to insert his body between the skis with the safety ropes tied in place. Next, the skier places the propulsion sticks into the clamps to create the stablized catamaran structure. The skier then pulls his body up to the top surface of the skis with his hands on the top surface to enable the skier to slip his legs into cavity 64 of each ski and to stand up. The skier is then ready to remove the propulsion sticks from the clamps and to resume skiing. In addition, the skier can rest on the catamaran structure when he is tired or if necessary in case of emergency.

The invention in its broader aspects is not limited to the specific details shown and described, and departures may be made from such details without departing from the principles of the invention and without sacrificing its chief advantages.

What is claimed is:

1. Equipment for towless skiing on water surface, said equipment including a pair of propulsion sticks, each stick comprising:

a rod;

a hand grip located at a first end of said rod; and a water-buoyant member located at a second end of said rod, said buoyant member defining a truncated conical part attached to said rod, a conical part, and a cylindrical part between said conical part and said truncated conical part, said conical part protruding from said cylindrical part.

2. Equipment as in claim 1 wherein said cylindrical part defines a first plurality of grooves substantially equally spaced apart around the exterior surface of said cylindrical part.

3. Equipment as in claim 2 wherein said conical part defines a second plurality of grooves radiating from the apex of said conical part and substantially equally spaced apart around the exterior surface of said conical part.

4. Equipment as in claim 3 wherein each of said second plurality of grooves is aligned with and in communication with one of said first plurality of grooves to form a single, continuous depression.

5. Equipment as in claim 4 wherein the interior apex angel of said conical part is substantially greater than the imaginary interior apex angle of said truncated conical part.

6. Equipment as in claim 5 wherein the height of said cylindrical part is substantially equal to the height of said conical part.

7. Equipment as in claim 6 wherein the height of said truncated conical part is at least substantially five times greater than the height of said cylindrical part.

8. Equipment as in claim 7 wherein said buoyant member is comprised of foam material.

9. Equipment as in claim 1 for towless skiing on water surface, said equipment further including a pair of skis, each ski comprising:

an elongated ski-shaped body defining a bottom surface and an upper surface;

first and second opposed side surfaces extending between said upper and bottom surfaces;

said bottom surface curving upwardly in a forward direction at a forward end of said body to meet said upper surface;

said first and second side surfaces each defining a shoulder extending downwardly from said upper surface and along the length of said body;

each of said shoulders further defining a lower surface which extends along the length of said body; and said body defining a cavity for receiving a user's foot and the lower part of the user's leg.

10. Equipment as in claim 9 wherein said lower surface defines a slope with respect to said bottom surface which decreases in a predetermined manner as said lower surface extends from the front of said body to a predetermined location along the length of said body.

11. Equipment as in claim 10 wherein said lower surface defines a slope with respect to said bottom surface which increases in a predetermined manner as said lower surface extends rearwardly from said predetermined location.

12. Equipment as in claim 11 wherein each of said skis includes:

a first rope-fastening element attached to a forward portion of said bottom surface; and a second rope-fastening element attached to a rearward portion of said bottom surface.

13. Equipment as in claim 12 wherein said first rope-fastening element is located above the immersion line of said ski wherein said second rope-fastening element is located below the immersion line of said ski.

14. Equipment as in claim 13 wherein said skis are comprised of foam material.

15. Equipment as in claim 9 wherein the maximum cross-sectional area of said buoyant member is greater than the maximum cross-sectional area of each of said skis.

16. Equipment for towless skiing on water surface, said equipment including a pair of skis, each ski comprising:

an elongated ski-shaped body defining a bottom surface and an upper surface;

first and second opposed side surfaces extending between said upper and bottom surfaces;

said bottom surface curving upwardly in a forward direction at a forward end of said body to meet said upper surface;

said first and second side surfaces each defining a shoulder extending downwardly from said upper surface and along the length of said body;

each of said shoulders further defining a lower surface substantially perpendicular to said side surface which extends along the length of said body and wherein said lower surface defines a slope with respect to said bottom surface which decreases in a predetermined manner as said lower surface extends from the front of said body to a predetermined location along the length of said body; and said body defining a cavity for receiving a user's foot and the lower part of the user's leg.

17. Equipment as in claim 16 wherein said lower surface defines a slope with respect to said bottom surface which increases in a predetermined manner as said lower surface extends rearwardly from said predetermined location.

18. Equipment as in claim 17 wherein each of said skis includes:

a first rope-fastening element attached to a forward portion of said bottom surface; and a second rope-fastening element attached to a rearward portion of said bottom surface.

19. Equipment as in claim 18 wherein said first rope-fastening element is located above the immersion line of said ski and wherein said second rope-fastening element is located below the immersion line of said ski.

20. Equipment as in claim 19 wherein said skis are comprised of foam material.

* * * * *